United States Patent [19]

Fludd

[11] Patent Number: 4,972,943

[45] Date of Patent: Nov. 27, 1990

[54] STUDENT SUPPLY KIT

[76] Inventor: Thomas Fludd, 1031 Green Hill Rd., Charleston, S.C. 29412

[21] Appl. No.: 470,361

[22] Filed: Jan. 25, 1990

[51] Int. Cl.[5] ..... B65D 5/52; B05S 17/00

[52] U.S. Cl. ..... 206/45.24; 206/575; 206/1.7; 206/224

[58] Field of Search ..... 206/575, 1.7, 1.8, 1.9, 206/224, 45.24; 220/22

[56] References Cited

U.S. PATENT DOCUMENTS

| | | | |
|---|---|---|---|
| H467 | 5/1988 | Gladden | 206/575 |
| Re. 19,403 | 12/1934 | Wilson | 206/1.8 |
| 1,235,521 | 7/1917 | Koenig | 206/45.24 |
| 1,369,439 | 2/1921 | Johnson | 206/224 |
| 2,593,138 | 4/1952 | Gombants | 206/1.7 |
| 3,273,700 | 9/1966 | Moreau et al. | 206/1.7 |
| 3,338,389 | 8/1967 | Sellen et al. | 206/224 |
| 3,481,452 | 12/1969 | Pickios | 206/224 |
| 3,840,113 | 10/1974 | Bartleson | 206/575 |
| 3,954,314 | 5/1976 | Crawford | 206/224 X |
| 4,406,368 | 9/1983 | Hermes | 206/1.7 |
| 4,416,632 | 11/1983 | Berman | 206/575 |
| 4,584,042 | 4/1986 | Wandroik | 206/575 |
| 4,591,056 | 5/1986 | Groch | 206/224 X |
| 4,696,400 | 9/1987 | Warman | 206/575 |
| 4,708,817 | 11/1987 | Dudnick | 206/1.7 |
| 4,852,725 | 8/1989 | Folsom | 206/575 |

FOREIGN PATENT DOCUMENTS

| | | | |
|---|---|---|---|
| 372009 | 5/1932 | United Kingdom | 206/45.24 |

*Primary Examiner*—William I. Price
*Attorney, Agent, or Firm*—Leon Gilden

[57] ABSTRACT

A kit including a multi-compartmented tray with provision for required student articles, such as pencils, crayons, glue, paste, paint, erasure sticks, and the like. The tray walls are of a height substantially less than the defined diameter of the associated jars to conveniently project the jars relative to the tray compartments for ease of access thereto. Jar positioning apparatus includes a pneumatic "L" shaped chamber mounted within an "L" shaped support bracket, wherein the "L" shaped chamber includes a button member directed through the bracket, whereupon depressing of the button member ejects an associated jar upwardly relative to the bracket while tilting the bracket forwardly due to a pivotal connection of the bracket to the floor of the compartment. A further modification includes a flexible container utilizing an accordion connection between the container and the floor of the compartment, whereupon a further button mounted adjacent a lowermost portion of each container will direct a contained jar therewithin upwardly relative to the container upon depressing of the further button forcing the flexible container to collapse inwardly about a lowermost portion of each jar to direct each jar upwardly for access thereto.

4 Claims, 5 Drawing Sheets

FIG 1
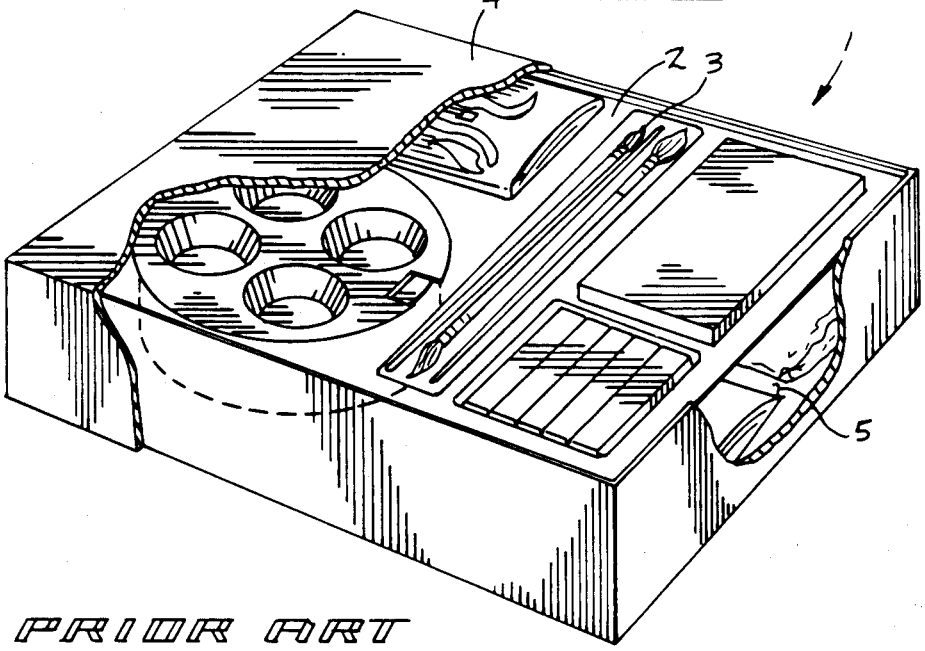
PRIOR ART
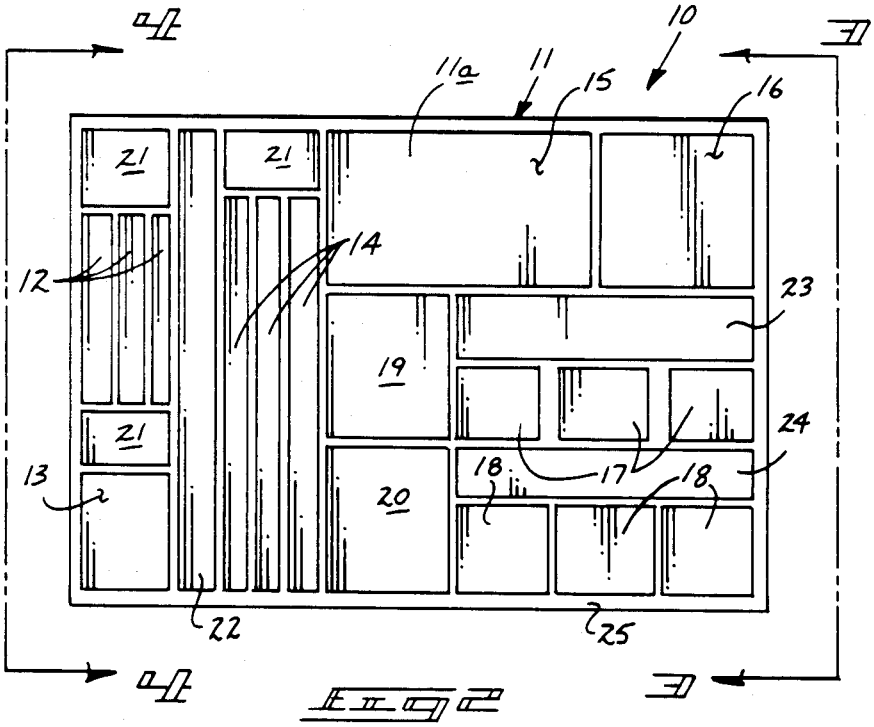
FIG 2

STUDENT SUPPLY KIT

BACKGROUND OF THE INVENTION

1. Field of the Invention

The field of invention relates to student supply apparatus, and more particularly pertains to a new and improved student supply kit wherein the same conveniently and securedly maintains components of a student supply kit relative to a compartmented tray organization.

2. Description of the Prior Art

Various student supply organizations are provided in the prior art to present a readily and conveniently accessible array of student supply commodities for convenient access by individuals, such as students, artists and the like. The prior art has heretofore failed to address particular needs of art students and the like to provide an organization for the convenient and accessibility of various components utilized in a student's training. Examples of the prior art include U.S. Pat. No. 3,481,452 to Pickios setting forth the use of a draftman's kit utilizing a planar floor and a pivoted rear plate to secure and position various drafting components thereabout.

U.S. Pat. No. 4,406,368 to Hermes provides a drawing tool compartment wherein a plurality of trays and bins are mounted throughout a tool organizer to secure various components therewithin.

U.S. Pat. No. 3,338,389 to Sellen, et al., sets forth a lettering kit wherein a lid pivoted upwardly provides access to various components contained wholly within a bottom compartment of a tray.

U.S. Pat. No. 1,369,439 to Johnson sets forth a drawing board and instrument case wherein a closure lid, upon opening, provides access to various compartments contained within the organization.

As such, it may be appreciated that there is a continuing need for a new and improved student supply kit wherein the same addresses both the problems of presenting an organized array of components utilized by a student, as well as positioning the articles for convenient access by the student and particularly directing the jars exteriorly of the walls of a support tray for access thereto, and in this respect, the present invention substantially fulfills this need.

SUMMARY OF THE INVENTION

In view of the foregoing disadvantages inherent in the known types of supply kit organizations now present in the prior art, the present invention provides a student supply kit wherein the same provides a compartmented tray including a rearwardly pivoted leg to support and present various components for access to a student in use of such components. As such, the general purposes of the present invention, which will be described subsequently in greater detail, is to provide a new and improved student supply kit which has all the advantages of the prior art supply kit organizations and none of the disadvantages.

To attain this, the present invention provides a kit including a multi-compartmented tray with provision for required student articles, such as pencils, crayons, glue, paste, paint, erasure sticks, and the like. The tray walls are of a height substantially less than the defined diameter of the associated jars to conveniently project the jars relative to the tray compartments for ease of access thereto. Jar positioning apparatus includes a penumatic "L" shaped chamber mounted within an "L" shaped support bracket, wherein the "L" shaped chamber includes a button member directed through the bracket, whereupon depressing of the button member ejects an associated jar upwardly relative to the bracket while tilting the bracket forwardly due to a pivotal connection of the bracket to the floor of the compartment. A further modification includes a flexible container utilizing an accordion connection between the container and the floor of the compartment, whereupon a further button mounted adjacent a lowermost portion of each container will direct a contained jar therewithin upwardly relative to the container upon depressing of the further button forcing the flexible container to collapse inwardly about a lowermost portion of each jar to direct each jar upwardly for access thereto.

My invention resides not in any one of these features per se, but rather in particular combination of all of them herein disclosed and claimed and it is distinguished from the prior art this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therfore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not fimilar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved student supply kit which has all the advantages of the prior art supply kit organizations and none of the disadvantages.

It is another object of the present invention to provide a new and improved student supply kit which may be easily and efficiently manufactured and marketed.

It is a further object of the present invention to provide a new and improved student supply kit which is of a durable and reliable construction.

An even further object of the present invention is to provide a new and improved student supply kit which is susceptible of a low cost of manufacture with regard to both materials and labor, and which accordingly is then susceptible of low prices of sale to the consuming public, thereby making such student supply kits economically available to the buying public.

Still yet another object of the present invention is to provide a new and improved student supply kit which provides in the apparatuses and methods of the prior art some of the advantages thereof, while simultaneously overcoming some of the disadvantages normally associated therewith.

Still another object of the present invention is to provide a new and improved student supply kit wherein the same positions and enables grasping of various components from the organization in a convenient and accessible manner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a typical prior art supply kit organization.

FIG. 2 is an orthographic top view of the kit of the instant invention.

DESCRIPTION OF THE PREFERRED EMBODIMENT

Figure 3:
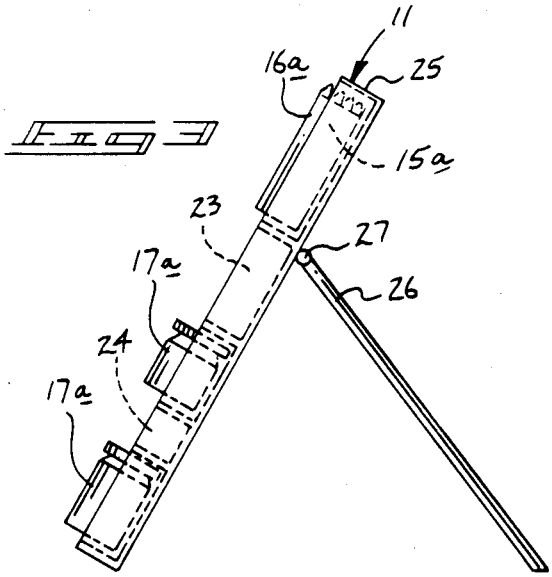
FIG. 3 is an orthograhic view taken along the lines 3—3 of FIG. 2 in the direction indicated by the arrows.

With reference now to the drawings, and in particular to FIGS. 1 to 11 thereof, a new and improved student supply kit embodying the principles and concepts of the present invention and generally designated by the reference numeral 10 will be described.

FIG. 1 is illustrative of a typical prior art storage assembly 1 utilizing an enclosed compartment 4 provided with a series of compartmentalized members 3 formed within a tray 2 overlying a storage compartment 5 underneath. Access to the various components of the prior art requires disassembly of the organization, as illustrated in FIG. 1.

Figure 4:
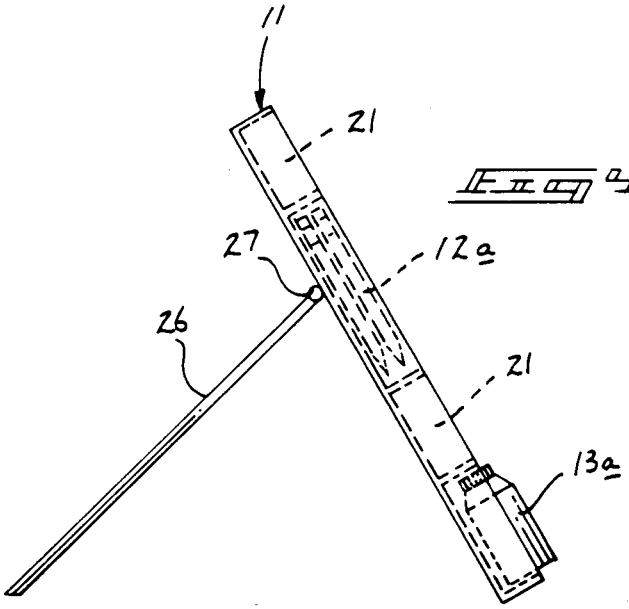
FIG. 4 is an orthographic view taken along the lines 4—4 of FIG. 2 in the direction indicated by the arrows.
Figure 5:
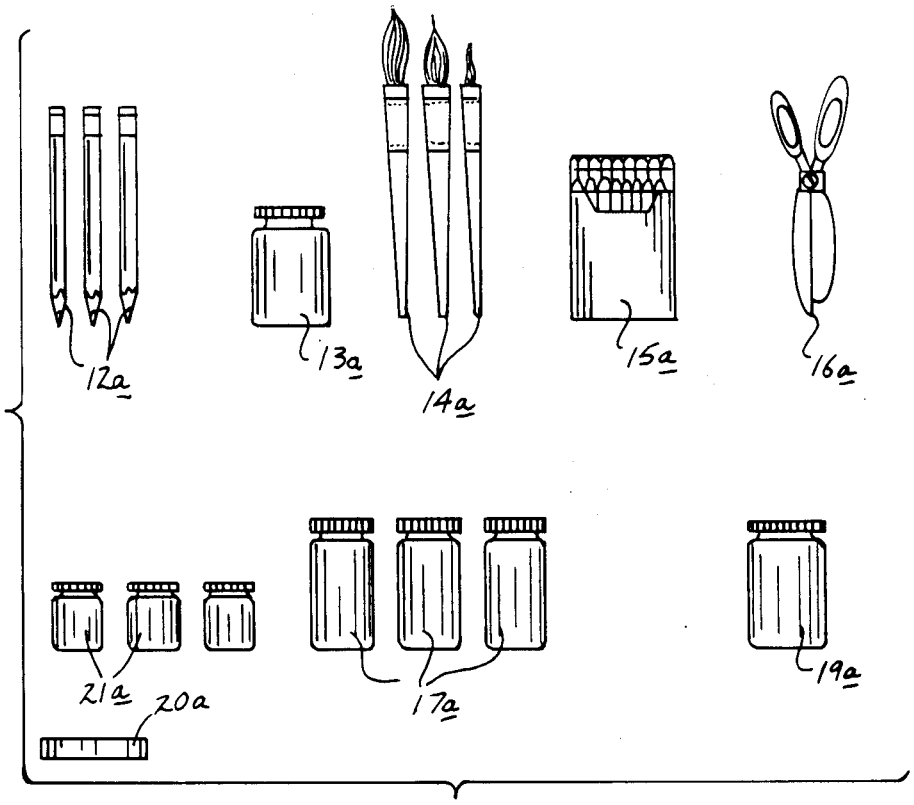
FIG. 5 is a top orthographic view of various components utilized by the instant invention.
Figure 6:
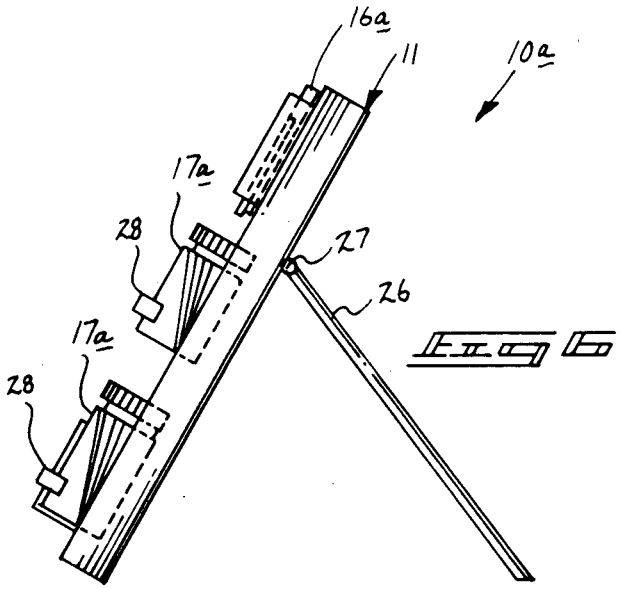
FIG. 6 is an orthographic side view taken in elevation of the instant invention utilizing modified jar securement apparatus.
Figure 7:
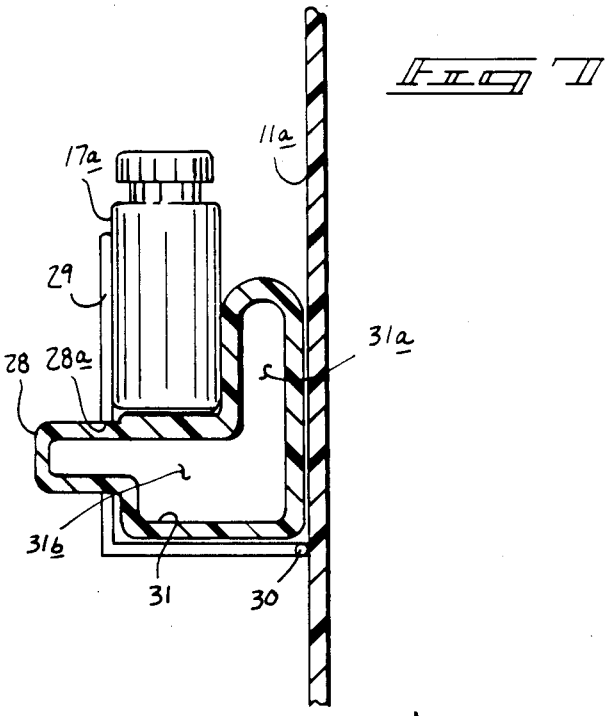
FIG. 7 is an orthographic cross-sectional view of a jar securement organization.
Figure 8:
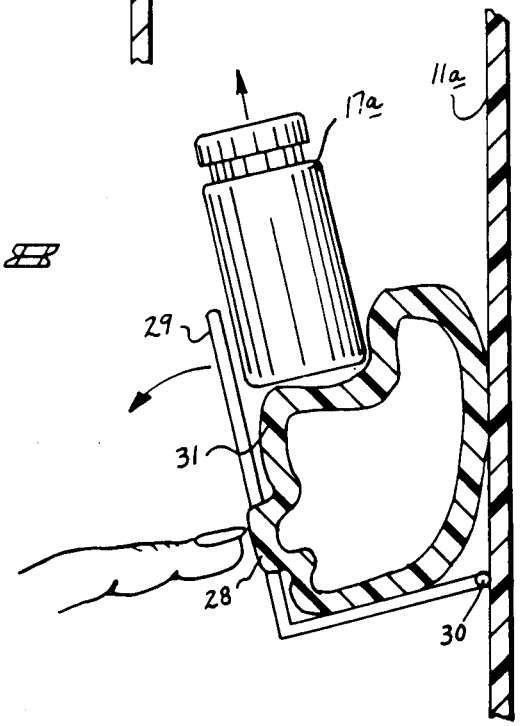
FIG. 8 is an orthographic side view taken in elevation of a jar securment apparatus in a contracted configuration directing a jar upwardly thereof.
Figure 9:
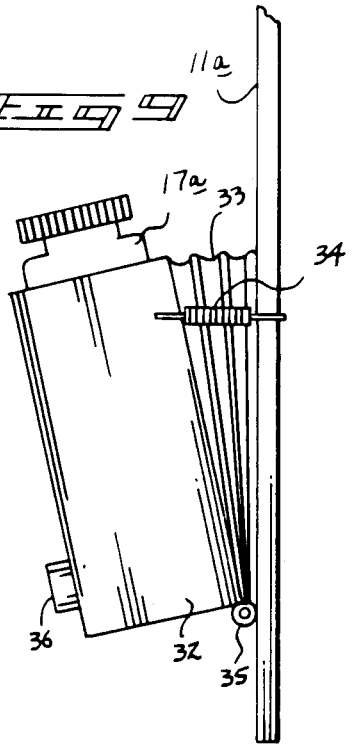
FIG. 9 is an orthographic side view taken in elevation of a modified jar securement apparatus.
Figure 10:
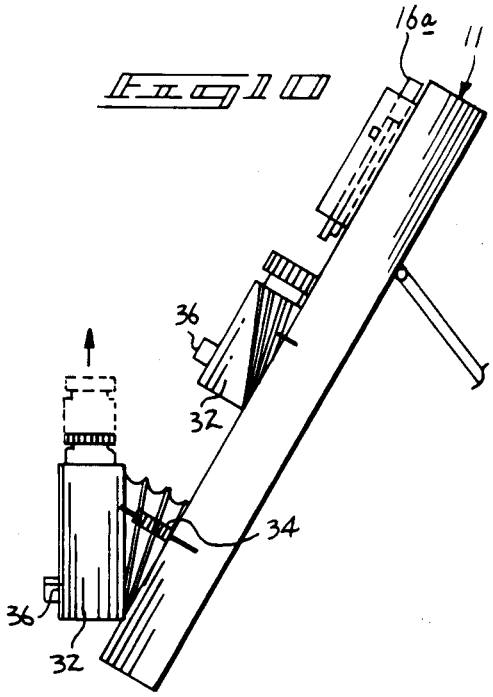
FIG. 10 is an orthograhic side view taken in elevation of the jar securement apparatus of FIG. 9 mounted to the support tray.

More specifically, the student supply kit 10 of the instant invention essentially comprises a compartmented storage tray 11 defined by a coextensive, planar compartment floor 11*a* with a rectangular perimeter tray wall 25 in surrounding relationship relative to the floor 11*a*. The tray 11 includes a series of parallel divided pencil compartments 12 mounted in a side-by-side relationship mounting a series of pencils 12*a* (see FIG. 5), as well as a glue jar compartment 13 mounting a glue jar 13*a* therewithin, a paint brush compartment 14 comprising a series of parallel elongate side-by-side compartments securing a series of paint brushes 14*a* therewith. Further, a crayon container compartment 15 is provided to mount a crayon container 15*a* therewith, with a scissor compartment 16 mounting a pair of scissors 16*a* therewithin. An upper series of spaced jar compartments 17 mount a series of paint jars 17*a* therewithin, with a lower series of spaced paint jar compartments 18 mounting a further series of paint jars 17*a* therewithin. A paste jar 19, an eraser storage container 20 mounted therewithin a paste jar 19*a* and erasure strips 20*a* therewithin respectively. Spaced cleaning fluid compartments 21 mount cleaning fluid jars 21*a* therewithin wherein a first, second, and third accessory compartment 22, 23, and 24 resectively are provided to mount accessory items such as clips, string, and the like. It should be noted that the various jars, such as the past jar 19*a* the glue jar 13*a*, the paint jar 17*a*, and the like, are of a diameter greater than that defined by the height of the associated tray wall 25 to enable ease of access to the jars during use. The tray 11 further includes a support leg 26 utilizing a pivot connection 27 at an upper terminal end of the support 26 to pivotally mount the support leg 26 to the rear surface of the compartment floor 11*a* to orient the tray 11 in a raised orientation, generally at an acute angle relative to a support surface, as illustrated in FIGS. 3 and 4 for example, FIGS. 6, 7, and 8 illustrate the use of a modified jar securement apparatus wherein an "L" shaped containment wall 29 (see FIGS. 7 and 8 for example) is pivotally mounted by a pivot connection 30 to the floor 11*a* of the tray 11. A pneumatic bladder 31 is contained with the "L" shaped containment wall 29 and includes a bladder projection 28 extending through an aperture 28*a* formed within the containment wall 29. The bladder 31 is completely enclosed to contain a predetermined quantity of air therewithin, wherein the pneumatic bladder 31 is defined by a vertical chamber 31*a* orthogonally oriented relative to a horizontal chamber 31*b*. The bladder projection 28 is longitudinally aligned with a horizontal chamber 31*b*, whereupon depressing of the bladder projection 28 interiorly of the "L" shaped containment wall 29 deforms the pneumatic bladder 31 and simultaneously rotates the containment wall 29 forwardly, as illustrated in FIG. 8, while simultaneously directing an associated jar 17*a* vertically upwardly relative to a horizontal leg of the containment wall 29 to enhance access to the jar for use thereof. Attention to FIG. 9 and 10 illustrate a modified jar dispensing and securement organization wherein a flexible tubular container 32 is secured to the compartment 11*a* by a flexible accordion skirt 33 that is normally biased in a compressed configuration by a return spring 34 at one end to the floor 11*a* and at the other end to the container 32. Upon depressing of an ejection button 34 associated with a bladder such as illustrated in FIG. 8, the container 32 is displaced and simultaneously rotated about a container hinge 35 mounting the container 32 to the floor 11*a*, as illustrated in FIGS. 9 and 10.

Figure 11:
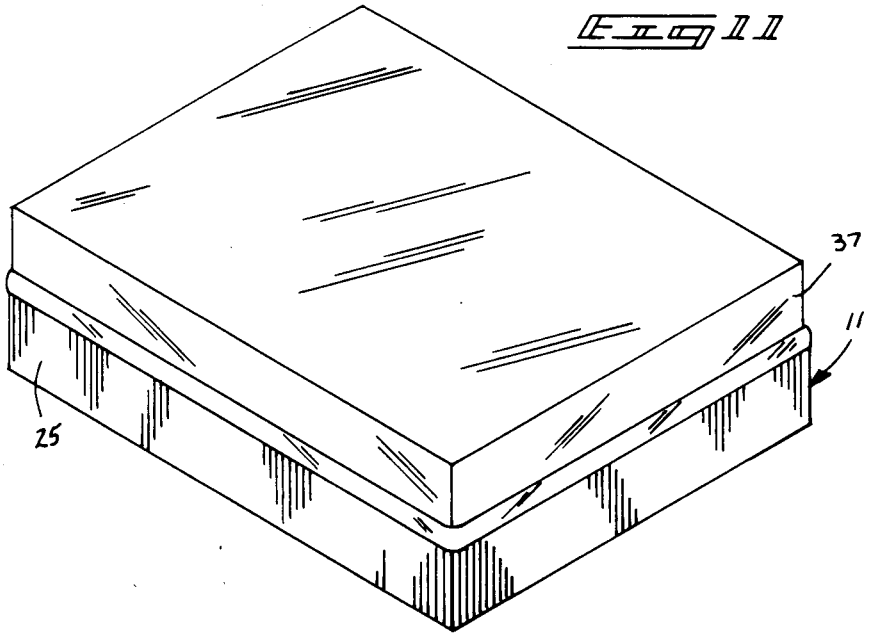
FIG. 11 is an isometric illustration of the instant invention with a snap-fit transparent cover mounted thereon.

FIG. 11 illustrates the use of a snap-fit transparent cover 37 arranged to overlie the wall 25 and secure the various components within the tray 11 for storage and transport thereof.

As to the manner of usage and operation of the instant invention, the same should be aparent from the above disclosure, and accordingly no further discussion relative to the usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A student supply kit comprising, in combination, a multi-compartmented tray including a planar floor and a continuous perimeter wall directed orthogonally and upwardly about a perimeter of the floor, and wherein the wall is defined by a predetermined height, and a series of components contained within respective compartments of the series of compartments of the tray, the components including writing instruments, coloring instruments, and container jars, and the container jars defined by a predetermined width, wherein the predetermined width is greater than the predetermined height defined by the perimeter wall to provide enhanced access to the container when the container jars are longitudinally aligned and positioned within a respective compartment, and wherein the tray includes a support leg, and a hinge connecting an upper terminal end of the support leg to a rear surface of the floor to present the tray at an acute angle relative to an underlying support surface, and wherein the container jars are contained within respective support compartments, and each support compartment includes a generally vertical wall and a horizontal wall, and a rear terminal end of the horizontal wall pivotally connected to the floor, including an elongate hinge connecting the horizontal wall to the floor.

2. A kit as set forth in claim 1 further including a transparent cover including a lower edge arranged to snap-fit overlying an upper free edge of the tray wall for transport and storage of the kit.

3. A kit as set forth in claim 2 wherein the components further include a pair of scissors, and a plurality of erasure members contained within respective compartments of the compartments of the tray, and the container jars include a glue jar, a paste jar, and plural series of paint jars.

4. A kit as set forth in claim 1 wherein each vertical wall of each support compartment is formed with an aperture therethrough, and a pneumatic bladder contained within each support compartment with a bladder projection directed through the aperture, and the pneumatic bladder including a vertical chamber and a horizontal chamber, and the bladder projection longitudinally aligned with the horizontal chamber, whereupon manual depressing of the bladder projections compacts the bladder and directs an associated jar upwardly relative to the vertical wall while simultaneously rotating the support compartment relative to the floor.

* * * * *